United States Patent [19]

Laverick

[11] Patent Number: 4,632,030

[45] Date of Patent: Dec. 30, 1986

[54] PRINTING PRESS WASHER

[75] Inventor: William J. Laverick, Chula Vista, Calif.

[73] Assignee: Wizer Equipment, Inc., National City, Calif.

[21] Appl. No.: 718,238

[22] Filed: Apr. 1, 1985

[51] Int. Cl.[4] ..... B41L 41/06; B41F 35/06

[52] U.S. Cl. ..... 101/425; 101/167

[58] Field of Search ..... 101/425, 167

[56] References Cited

U.S. PATENT DOCUMENTS

| | | | |
|---|---|---|---|
| 2,302,490 | 11/1942 | Curtis | 101/425 |
| 2,969,735 | 1/1961 | Cope et al. | 101/425 |
| 2,970,541 | 2/1961 | Gegenheimer | 101/425 |

FOREIGN PATENT DOCUMENTS

| | | | |
|---|---|---|---|
| 2101473 | 1/1971 | Fed. Rep. of Germany | 101/425 |
| 710568 | 7/1966 | Italy | 101/425 |
| 381715 | 10/1964 | Switzerland | 101/425 |

*Primary Examiner*—Edgar S. Burr
*Assistant Examiner*—Tonya Eckstine
*Attorney, Agent, or Firm*—Baker, Maxham & Jester

[57] ABSTRACT

A printing press washer with an elongated tray having a roller engaging wiper blade extending along a front edge for engaging the surface of the lower oscillating roller of an offset lithographic printer, a pair of hanging brackets having hanging hooks for hooking over a transverse tie bar below the ink fountain, and adjusting screws for engaging the frame of the machine for adjusting the wiper blade engagement and pressure on the lower oscillating ink roller of a printing press.

3 Claims, 4 Drawing Figures

FIG. 2
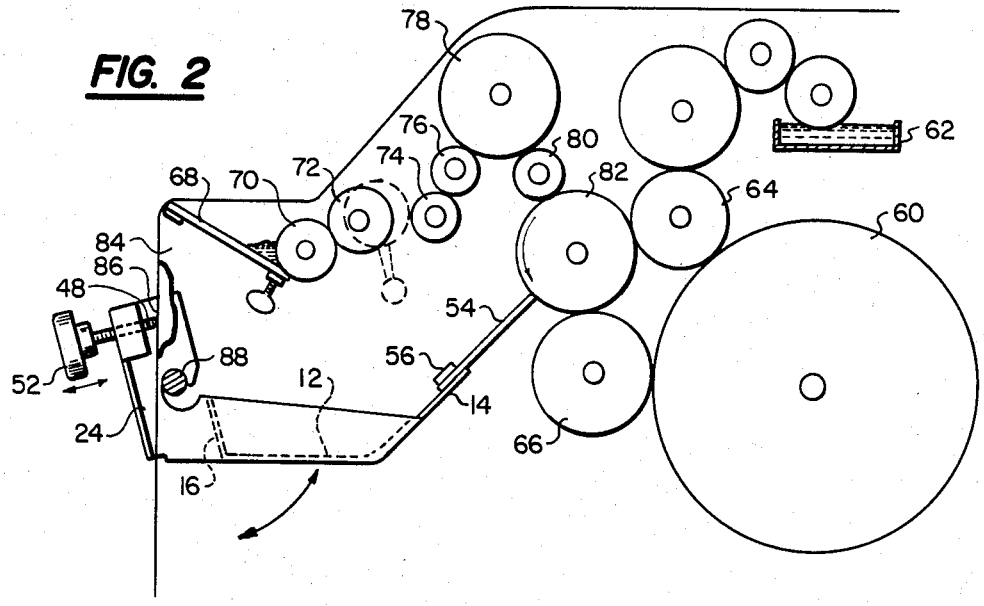
FIG. 1
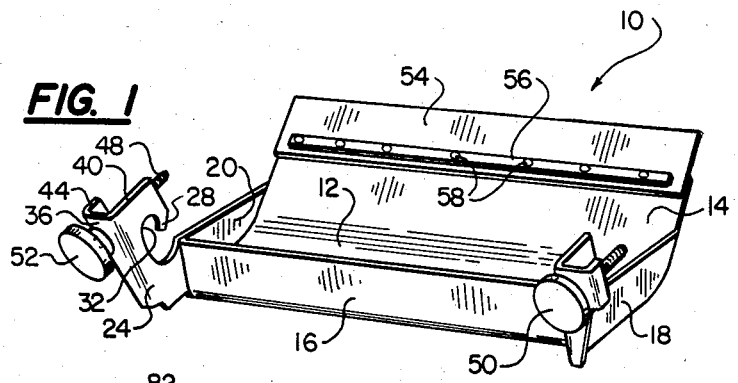
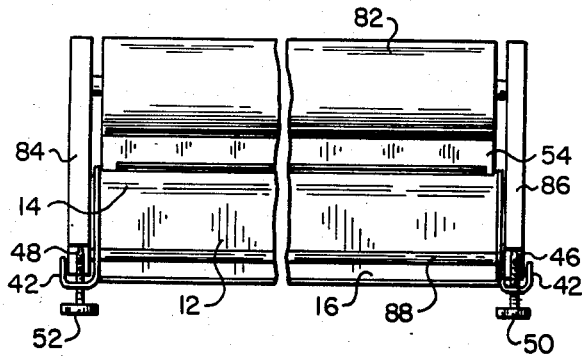
FIG. 3
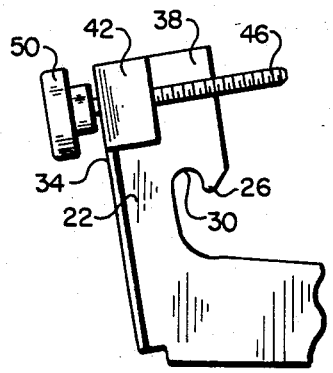
FIG. 4

PRINTING PRESS WASHER

BACKGROUND OF THE INVENTION

The present invention relates to printing presses and pertains particularly to a washer for the ink rollers of a lithographic press.

The rollers of a printing press must be periodically cleaned, particularly at the end of each workday. It is often necessary to clean the rollers more often, particularly when different colors of ink are to be used.

The typical approach to the cleaning of the rollers of small presses, such as the lithographic type, is by means of cleanup sheets. Cleanup sheets are absorbent sheets of paper similar to paper towels that are used to wipe ink from the rollers. The ink on the rollers is first softened by water or a suitable solvent and then wiped off with the cleanup sheets. This is a time consuming and dirty task, usually taking upwards of about forty-five minutes for the typical machine.

Accordingly, it is desirable that an improved method and apparatus be available for cleaning ink and the like from the rollers of a printing press.

SUMMARY AND OBJECTS OF THE INVENTION

It is the primary object of the present invention to provide an improved apparatus and method for cleaning the rollers of printing presses.

In accordance with the primary aspect of the present invention, a cleaning attachment for cleaning ink from the rollers of a printing press of the lithographic type comprises an elongated open trough defined by a pair of generally parallel extending walls defining a forward wall and a rear wall with the forward wall including a wiper blade for extending along an edge thereof for engaging an ink roller and support brackets at each side of the trough for hanging on a tie bar of a printing press beneath the rollers with adjusting screws on the support brackets for engaging the frame of the machine for selectively adjusting the wiping blades into engagement with the ink roller.

BRIEF DESCRIPTION OF THE DRAWINGS

The above and other objects and advantages of the present invention will become apparent from the following description when read in conjunction with the drawings wherein:

FIG. 1 is a perspective view of a press washer attachment in accordance with the invention;

FIG. 2 is a side elevation view of a typical press roller assembly showing a press washer in accordance with the invention in use;

FIG. 3 is a top plan view of the press washer of FIG. 3 shown in engagement with a roller;

FIG. 4 is a detailed side elevation view of a support bracket of the press washer of FIG. 1.

DETAILED DESCRIPTION OF A PREFERRED EMBODIMENT

Referring now to the drawings, particularly to FIGS. 1 and 2, there is illustrated a printing press washer in accordance with the invention designated generally by the numeral 10. The press washer, in accordance with the invention as can be seen in FIGS. 1 and 2, comprises a generally rectangular shallow trough or tray 10 comprised of a generally flat rectangular bottom 12 curved upward at a forward end to define a forward wall 14 and at the rear to define a rear wall 16. The forward and rear walls 14 and 16 extend generally in parallel directions but not in parallel planes along the forward and rear edges of the bottom 12. The forward wall 14 is preferably at about a forty-five degrees angle to the bottom extending outward. The rear wall 16 is preferably at about a ten to twenty percent angle to the bottom.

A pair of side or end walls 18 and 20 close the trough to provide an open top trough or container capable of receiving and containing a liquid or the like. The side walls are generally mirror images of one another, each include formed integral therewith a backward and upwardly extending support bracket 22 and 24, respectively. The brackets and the side walls may be formed of an integral sheet of metal or the like cut and formed (e.g. stamped) into a structure defined by a unitary sheet.

The support bracket, as can be best seen in FIG. 4, comprises a rearward extension of the side walls 18 and 20, positioning the bracket aft or behind the tray with an arm portion extending upward above the tray with a forward and downwardly extending hook 26 and 28, each forming a similar semi-circular recess 30 and 32 respectively for receiving a tie rod 88 on the frame of a printing press as will be described. The hooks 26 and 28 extend generally forward from the arm like bracket and downward toward the tray for hooking over the tie rod. A hook, as defined herein, comprises a structure forming a point formed on a body member and extending generally parallel backward toward the body member as in a fish hook, bale hook or the like.

The support bracket further comprises a channel structure defined by a vertically and outwardly extending rear wall 34 and 36 extending outward from each of the brackets upward to an upper end with side wall portions 38 and 40 extending foward defining the structure in which the hooks 26 and 28 are formed. The upward or channel portion further includes an outer wing or panel 42 and 44 forming a channel that, as can be seen in FIG. 3, extends around a vertical edge of a side frame 84, 86 of a press. Each of the brackets include a hand screw 46 and 48 having a head or knob 50 and 52 respectively thereon for grasping with a hand for rotating the screw.

The forward wall of the tray or trough includes a wiper blade 54 detachable mounted along the upper edge of the wall 14 and extending fowward and upward for engaging a roller. This wiper blade is preferably made of a generally rectangular sheet of resilient or flexible material such as rubber or the like. The wiper blade 54 is detachably attached such as by means of a thin bar or strap 56 attached such as by a pluarlity of bolts or screws 58 directly to the upper edge of the forward wall 14. Because ink must run over bar or strap 56, the bar or strap must be sufficiently thin as not to significantly interfere with the flow of ink. The bar or strap 56 need be only of such thickness as to prevent the heads of bolts or screws 58 pulling through the holes in the wiper blade 54.

Because the lithographic offset type printing press is typically of a fairly standard construction and roller arrangement with minor variations, the press washer attachment of the present invention will fit a number of different model machines made by several different manufacturers. The press washer is designed to fit below the ink well and ink rollers engaging the lower oscillating ink roller of a typical press arrangement.

Referring to FIG. 2 of the drawing, a typical lithographic press roller arrangement is illustrated. In the typical arrangement, the printing press includes an arrangement of rollers controllably feeding moisture and ink to a main press roll 60 on which the printing plates are mounted for forming the image on paper and the like. The moisture roller train comprises a series of rollers which lead from a water fountain 62 to an upper press roller 64 which is in rolling contact with the roller 60. A lower form roller 66 is also in contact with the main press roller 60 below the upper form roller 64.

The ink train comprises a series of rollers which lead from an ink well 68 by means of a first ink roller 70 through a ductor roller 72 (which oscillates transverse to its axis) and a pair of rollers 74 and 76 to a top or upper oscillating roller 78. This roller 78 oscillates along its axis and generally rests on the roller 76 and a second similar roller 80 which is in rolling contact with the lower oscillating roller 82. The lower oscillating roller 82 is in direct contact with both the upper form roller 64 and the lower form roller 66. This roller also oscillates along its axis by well known cam end follower mechanisms, not shown.

In a preferred arrangement of the printing press washer, the wiping blade 54 is mounted for wiping engagement with the surface of the lower oscillating ink roller 82.

In the typical machine, the rollers are mounted in suitable support bearings between a pair of side plates with the far plate shown at 84 and a portion of the near plate 86 illustrated (FIG. 2). The side frames 84 and 86 are held together by a number of structures including a number of tie bars or the like, one of which 88 is typically positioned just below the ink fountain 16 at one end of the machine. The present printing press washer is designed to hook over and hang on this tie bar 88 with the arm portions of the two brackets 22 and 24 extending just inside the surface of the frame members 84 and 86 as seen in FIG. 3 with the tray extending between the side frames and below the ink fountain and ink rollers for engagement of the wiper blade 54 with the roller 82. The bracket or channel portions of the brackets extend around the edge of the frame members 84 and 86 (FIG. 3) and position the adjusting screws 46 and 48 in direct engagement with the edge of the frame members 84 and 86. With this arrangement, the hooks 22 and 28 hook over the bar 88 with the bar fitting into the recesses 30 and 32 for holding the washer tray in place and for providing a pivot axis for the tray. The hand screws 50 and 52 may then be adjusted to tilt or pivot the tray 10 about bar or shaft 88 to selectively adjust the engaging pressure or wiping pressure of the wiper blade 54 as it engages the roller 82.

In operation, when it is desired to clean the rollers of a machine, the tray or washer is put into position as above described and as illustrated in FIG. 2 and the machine turned on. The roller 82 rolls in the counter clockwise direction as shown by the arrow, thus wiping the outer surface thereof against the upper or inside edge of the wiper blade 54 such that liquid contained thereon wipes onto the blade 54 running down into the bottom of the tray or trough 10. The machine after being turned on is operated with the water fountain adjusted to feed moisture onto the rollers and an additional amount of water of solvent or the like may be applied to a number of ink rollers beginning with roller 74, for example, through roller 82. The ductor roller 72 is preferably stopped and prevented from oscillating into alternate contact between rollers 70 and 74. It has been found that with this invention cleanup time can be reduced to approximately three to five minutes from the approximate forty-five minutes of the conventional approach. After the rollers are clean, the tray 10 can be removed, emptied, cleaned and stowed. Alternatively, the tray can be put back in place as shown in FIG. 2.

While I have illustrated and described my invention by means of specific embodiments, it is to be understood that numerous changes and modifications may be made therein without department from the spirit and scope of the invention as defined in the appended claims.

I claim:

1. A cleaning device for attachment to a lithographic type printing press for cleaning ink from the rollers of the printing press, comprising:

an elongated open top trough defined by a generally rectangular bottom, a pair of generally parallel extending walls defining a forward wall and a rear wall respectively, and a pair of parallel end walls extending upwardly from said bottom;

said forward wall extending above said end walls upward and forward at about a forty-five degree angle to said bottom and having a top edge, and a generally flat rectangular resilient wiper blade mounted thereon and extending upward from said top edge thereof for wiping engagement with an ink roller;

a pair of support brackets, one at each end of said trough, each bracket comprising an arm extending upward from one of said end walls and including hook means extending forwardly and down from said arm for hooking over and detachably hanging said trough to a tie bar of a printing press, each bracket including an outwardly extending portion overlapping a vertical edge of a side wall of a printing press frame; and an adjusting screw mounted in the outwardly extending portion of each of said brackets above said hook means for engaging a vertical edge of a side wall of said printing press frame for adjusting said wiping blade into engagement with the lower oscillating ink roller of said printing press.

2. A press attachment according to claim 1 wherein said bracket is defined by an upwardly extending arm formed as a unitary extension of said end wall and wherein said outwardly extending portion is a channel portion at the upper end of said arm.

3. A cleaning device for attachment to a lithographic type printing press for cleaning ink from the rollers of the printing press, comprising:

an elongated open top trough defined by a generally rectangular bottom, a pair of generally parallel extending walls defining a forward wall and a rear wall respectively, and a pair of parallel end walls extending upwardly from said bottom;

said forward wall extending upward above said end walls and forward at about a forty-five degree angle to said bottom and terminating with a top edge, and a generally flat rectangular resilient wiper blade mounted thereon and extending upward from said top edge for wiping engagement with an ink roller;

a pair of support brackets, one at each end of said trough, each bracket comprising an arm formed as a unitary extension of and extending upward from a respective one of said end walls, said arm being formed into a channel portion at the upper end, said channel portion including an outwardly extending rear wall portion extending behind a vertical edge of a side wall of a printing press frame, and hook means extending forwardly and down from said arm below said channel for hooking over and detachably hanging said trough to a tie bar of said printing press; and an adjusting screw mounted in said outwardly extending rear wall portion of each of said brackets above said hook means for engaging said vertical edge for adjusting said wiping blade into engagement with the lower oscillating ink roller of said printing press.

* * * * *